US006925366B2

(12) United States Patent
Theurer et al.

(10) Patent No.: US 6,925,366 B2
(45) Date of Patent: Aug. 2, 2005

(54) CONTROL SYSTEM AND METHOD OF MONITORING A WORK TRAIN

(75) Inventors: Josef Theurer, Vienna (AT); Bernhard Lichtberger, Linz (AT)

(73) Assignee: Franz Plasser Bahnbaumaschinen-Industriegesellschaft m.b.H., Vienna (AT)

( * ) Notice: Subject to any disclaimer, the term of this patent is extended or adjusted under 35 U.S.C. 154(b) by 0 days.

(21) Appl. No.: 10/846,215

(22) Filed: May 10, 2004

(65) Prior Publication Data

US 2004/0230355 A1 Nov. 18, 2004

(30) Foreign Application Priority Data

May 12, 2003 (AT) ..... A 720/2003

(51) Int. Cl.[7] ..... G06F 7/00

(52) U.S. Cl. ..... 701/19; 701/36; 701/50; 246/169 R; 340/439

(58) Field of Search ..... 701/19, 29, 36, 701/50, 300; 246/1 R, 1 C, 169 R, 20, 27; 340/438, 439

(56) References Cited

U.S. PATENT DOCUMENTS 5,815,823 A * 9/1998 Engle ..... 701/19
5,867,801 A * 2/1999 Denny ..... 701/35
5,956,664 A * 9/1999 Bryan ..... 702/184
6,484,083 B1 * 11/2002 Hayward et al. ..... 701/50
6,505,103 B1 * 1/2003 Howell et al. ..... 701/19

FOREIGN PATENT DOCUMENTS

AT 005 703 U2 10/2002

* cited by examiner

*Primary Examiner*—Richard M. Camby
(74) *Attorney, Agent, or Firm*—Laurecnce A. Greenberg; Werner H. Stemer; Ralph E. Locher

(57) ABSTRACT

A control system for monitoring a work train for performing track maintenance operations has a computer connected to receive information from a multitude of work vehicles constituting the work train. A respective vehicle identifying device is associated with each work vehicle, the vehicle identifying device being connected communicate with the computer (e.g., via a control line) and configured for storing vehicle characteristics defining the respective work vehicle. The computer connected to the control line includes a display for visually indicating, in the case of a malfunction report concerning a particular work vehicle, the respective vehicle characteristics in connection with the position of the respective vehicle within the work train.

13 Claims, 2 Drawing Sheets

CONTROL SYSTEM AND METHOD OF MONITORING A WORK TRAIN

BACKGROUND OF THE INVENTION

Field of the Invention

The present invention relates, in general, to a control system for monitoring a work train for performing track maintenance operations. The work train is mobile on a track.

Our commonly assigned Austrian utility model AT 5703 U (Gebrauchsmuster) describes a work train formed of several storage wagons, which is configured for transporting bulk material from one end of the work train all the way through to the other end and finally storing it for removal. In this manner, in a continuous working operation, for example for cleaning a ballast bed of a track, the storage wagons are successively filled and finally transported away together in order to be emptied. A control system in the shape of a contactlessly operating distance measuring device is associated with each storage wagon, respectively, for continuously monitoring the filling state of the wagon. By means of the distance measuring device, the height of a dump cone of bulk material inside the wagon is measured, and the storage operation is controlled automatically in accordance therewith.

SUMMARY OF THE INVENTION

It is accordingly an object of the present invention to provide a control system of the specified kind which overcomes the disadvantages of the heretofore-known systems and methods of this general type, and with which it is possible to obtain an optimal general view over the current operational status of the work train.

With the foregoing and other objects in view there is provided, in accordance with the present invention, a control system for monitoring a work train for performing track maintenance operations. The work train is mobile on a track and comprises a multitude of work vehicles, disposed one following the other on the track and releasably connected to one another. Working devices are respectively associated with the individual work vehicles, the working devices cooperating for achieving a common work result of the work train. A communication system (with a control line or with wireless communication) is provided that connect the work vehicles to one another. Vehicle identifying devices are respectively associated with the work vehicles, each vehicle identifying device is connected to the communication system and configured for storing vehicle characteristics defining the respective work vehicle. A computer including a display is connected to the communication system and configured for visually displaying a malfunction report generated as a result of a detected difference between actual and desired values of parameters essential for disturbance-free operation of a particular working device, the malfunction report being combined with the vehicle characteristics of the work vehicle associated with the said working device.

With the foregoing and other objects in view there is also provided, in accordance with the invention, a method of monitoring a work train for performing track maintenance operations, the work train being mobile on a track and composed of a multitude of work vehicles arranged one following the other, the work vehicles having working devices.

The novel method includes the steps of:

transmitting vehicle characteristics identifying a respective work vehicle to a computer via a control line or via wireless communications connecting the work vehicles to one another;

displaying the vehicle characteristics on a display of the computer in a sequence corresponding to the sequence of work vehicles in the work train; and displaying malfunction reports transmitted from a work vehicle—resulting from a difference between actual and desired values of parameters essential for disturbance-free operation of the respective working devices—on the display of the computer in connection with the respective vehicle characteristics and the position of the work vehicle within the work train.

With a control system of this kind, it is now possible to obtain in a simple and safe manner a clear general view of the current operational status of the entire work train. The view is assured entirely independently of a possibly changing combination of the individual vehicle types, resulting from a new grouping of the work train. The control system also makes it possible, in the case of a malfunction report concerning an individual work vehicle, to quickly assess the situation to see whether a continuation of the working operation of the work train is still possible. Due to the vehicle characteristics being arranged on the display in a sequence conforming to the actual sequence of the vehicles in the work train, it is possible for the operator to correspondingly locate, in a simple and direct manner, a vehicle causing a malfunction report.

With the method according to the invention it is assured that, after the work train has been assembled, the operator or the control system automatically has a general view of the vehicle types incorporated in the train. Since manual data entry is avoided, any data defects resulting from entry mistakes or faulty messages are reliably precluded. Due to the joint surveillance of all work vehicles being concentrated in a single position, it is possible in the event of the failure of an individual, essential working device to immediately stop the working operation of the work train in order to avoid possibly very damaging consequences. On the other hand, in the case of less serious malfunction reports, it can be quickly clarified whether further working operation, unrestricted or perhaps also restricted, is possible. Thus, an economically optimized operation of the work train for achieving a maximal work result is assured.

Other features which are considered as characteristic for the invention are set forth in the appended claims.

Although the invention is illustrated and described herein as embodied in a control system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
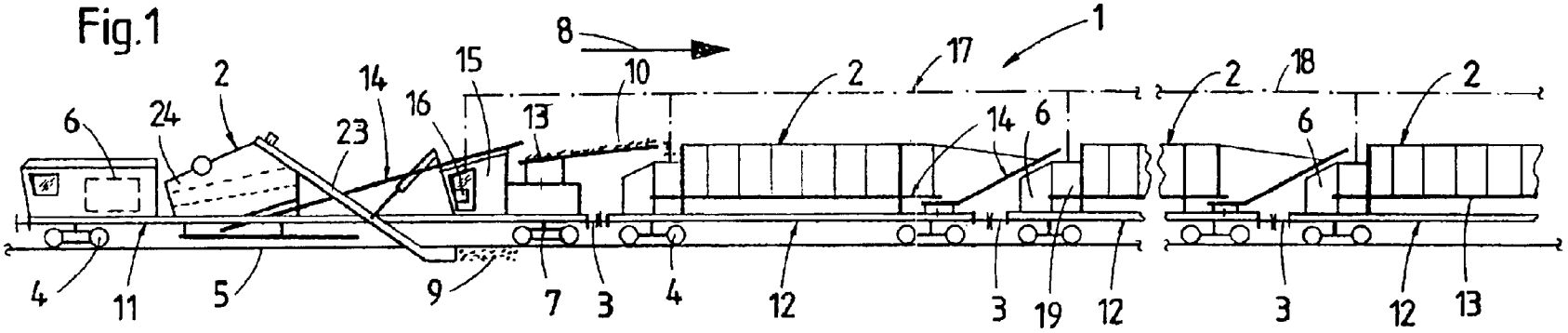
FIG. 1 is a schematic and simplified side elevational view of a work train on a track, the work train being composed of a multitude of individual work vehicles.

Referring now to the figures of the drawing in detail and first, particularly, to FIG. 1 thereof, there is shown a work train 1 composed of a multitude of work vehicles 2. The work vehicles 2 are disposed one following the other on a track 5 and are connected to one another by way of coupling devices 3. Each work vehicle 2 is supported for mobility on on-track undercarriages 4 and equipped with an energy supply unit 6 for the required power supply. The work train 1 is mobile in a working direction 8 with the aid of a motive drive 7.

The depicted work train 1 is provided for cleaning ballast 9 and for storing detritus 10 collecting in the process. The work vehicles 2 of the work train 1 include a cleaning machine 11, positioned at the rear end of the train, and a number of storage wagons or storage cars 12 preceding the same with regard to the working direction 8. Conveyor belts 13, generally called working devices 14, are associated with each work vehicle 2. The working devices 14 cooperate to achieve a common work result, namely, the transporting away and storing of the detritus 10.

A computer 16 of a control system 17 for monitoring the work train 1 is located in a work cabin 15 of the cleaning machine 11. The control system 17 is connected to each one of the work vehicles 2 by way of a schematically shown control line 18. Associated with each work vehicle 2 and connected to the control line 18 is a respective vehicle identifying device 19 (see FIG. 2) in which a vehicle identification number and model designation of the work vehicle 2 are stored. Also integrated into the software of the vehicle identifying device 19 is a maintenance counter 29 with a time keeper 30, which registers and stores the operating hours of the various working devices positioned on the work vehicle 2, such as the energy supply unit 6, conveyor drives 20, and the like.

In each storage wagon 12, actual values of the current state or condition of various items of equipment of the wagon, such as the speed of rotation or the travel speed of the conveyor belts 13, the motor speed, the filling height, etc., are constantly measured and transmitted via the control line 18 to the computer 16. These actual values are compared to stored desired values which are pertinent to the specific vehicle type. When a difference between actual and desired values is detected, a malfunction report issues which is shown on a display 21 of the computer 16 and also stored. The malfunction report is shown on the display 21 in combination with a classification or rating which corresponds to the magnitude of the found deviation from predefined tolerance ranges.

Figure 2:
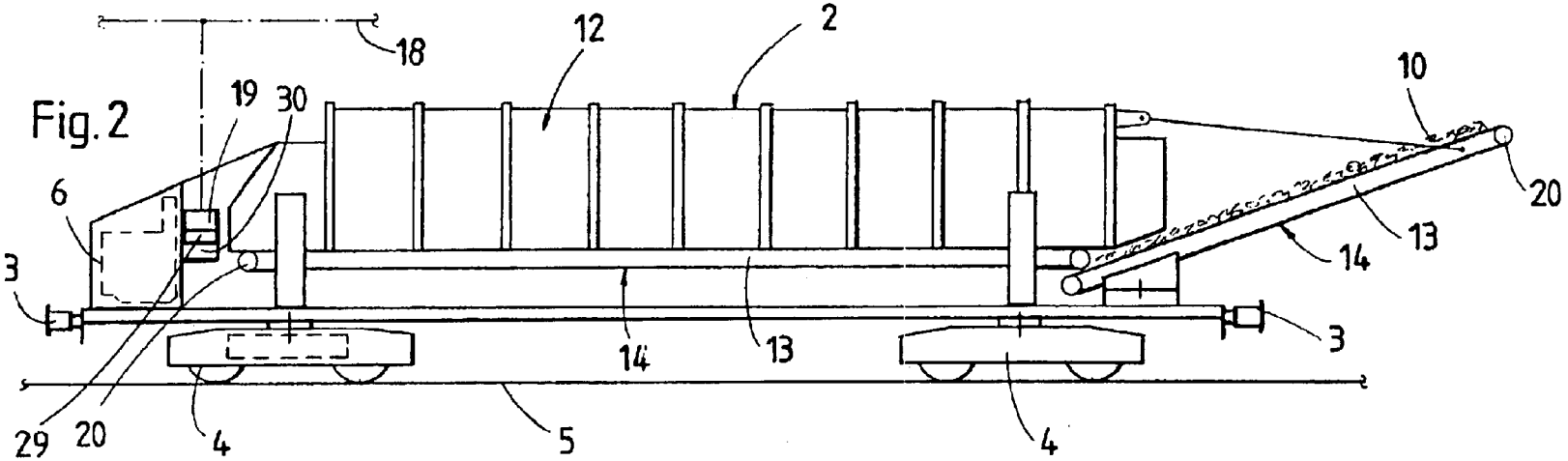
FIG. 2 is an enlarged side view of a work vehicle.

As represented in FIG. 2 on a larger scale, the storage wagon 12 or storage car 12 comprises working devices 14 in the shape of a conveyor belt 13, serving as a floor surface, and a further conveyor belt 13 which projects over the front end of the wagon and serves for passing detritus 10 on to the adjoining storage wagon 12. Each of the conveyor belts 13 has a separate conveyor drive 20. The ballast 9 taken up during continuous working advance by a clearing chain 23 of the cleaning machine 11 (see FIG. 1) is fed into a screening installation 24 for cleaning. The detritus 10 collecting in the process is transported via the conveyor belts 13, forming a common conveyor track, all the way to the storage wagon 12 positioned at the other end of the work train 1 and is stored therein for being transported away. For that purpose, the conveyor belt 13 serving as a floor surface runs at a slower speed.

Figure 3:
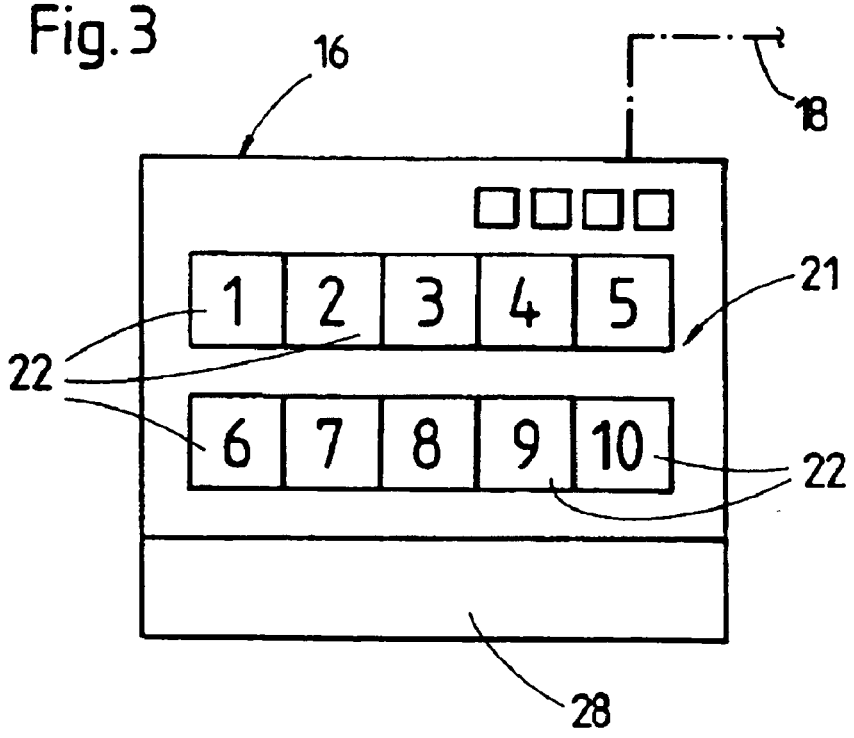
FIG. 3 is a schematic representation of an exemplary display of the control system.

The display 21, as shown in a simplified way in FIG. 3, has a number of visual indicator units 22 corresponding to the number of work vehicles 2 in the work train 1. The first indicator unit 22, denoted by the number "1," indicates the vehicle identification data of the cleaning machine 11, while the adjoining indicator units 22 indicate the vehicle identification data of the second, third and subsequent storage wagons 12. This association of the respective indicator unit 22 with the respective vehicle identifying device 19 ensues automatically by corresponding inquiry via the control line 18 in correspondence to the actual succession of work vehicles 2. Thus, the exact configuration of the work train 1, after it has been assembled, can be precisely recognized from the display 21. Accordingly, it is possible for the operator—if, for instance, the indicator unit named "5" should be activated by lighting up in case of a malfunction report—to perceive immediately that the respective malfunction report concerns the fifth work vehicle 2 in the work train 1.

In connection with a malfunction report, it is also advantageous if the respective indicator unit 22 lights up in different colors, depending on the classification or rating of the malfunction found. In further sequence, it is additionally possible, in the case of a touch screen, to call up a list of detailed data concerning the malfunction report or the corresponding work vehicle 2 by merely touching the lit indicator unit 22. The malfunction reports are displayed in a failure register 28 and stored.

Figure 4:
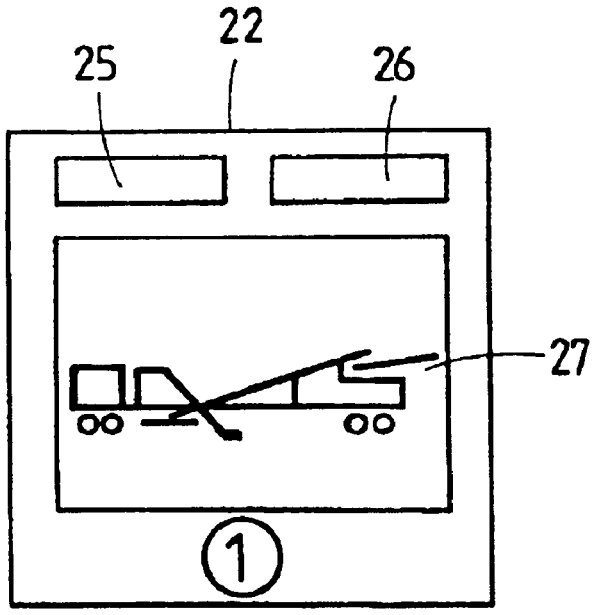
FIG. 4 is a schematic representation of a detail of the control system display with a different display content.

The enlarged scale view of FIG. 4 shows an indicator unit 22 concerning the first work vehicle 2 in the work train 1. The unit shows vehicle identification data which include, in a first data window 25, a vehicle identification number delivered by the vehicle identifying device 19 and, in a second data window 26, a model designation. To illustrate the vehicle type, the latter may be further represented in the shape of a corresponding picture 27. The various drives 20 and energy supply units 6 of the work vehicles 2 may be remotely controlled from the computer 16.

This application claims the priority, under 35 U.S.C. § 119, of Austrian patent application No. A 720/2003, filed May 12, 2003; the entire disclosure of the prior application is herewith incorporated by reference.

We claim:

1. A work train for performing track maintenance operations, the work train being mobile on a track and comprising:

a plurality of work vehicles, disposed one after another on the track and releasably connected to one another;

working devices respectively associated with individual said work vehicles, said working devices cooperating for achieving a common work result for the work train;

a control system for monitoring the work train, the control system including:

a communication device connecting said work vehicles to one another;

vehicle identifying devices respectively associated with said work vehicles, each of said vehicle identifying devices being connected to said communication device and configured for storing vehicle characteristics defining the respective said work vehicle; and a computer connected to said communication device and including a display, said computer being configured for visually displaying a malfunction report generated as a result of a detected difference between actual and desired values of parameters essential for disturbance-free operation of a particular working device, wherein the malfunction report is combined with the vehicle characteristics of the work vehicle associated with the said working device.

2. The control system according to claim 1, wherein said communication device includes a control line extending between the work vehicles and connecting said computer to each of the work vehicles.

3. The control system according to claim 1, wherein said display is configured for displaying visual indicator units associated respectively with said work vehicles and corresponding in number to a number of work vehicles in the work train, said indicator units being activatable in case of a corresponding malfunction report.

4. The control system according to claim 3, wherein said visual indicator units are arranged on said display in a sequence corresponding to a sequence of the work vehicles in the work train.

5. The control system according to claim 1, wherein each vehicle identifying device is further associated with a maintenance counter for tracking maintenance intervals prescribed for the respective said working device, and a time keeper activatable automatically after actuation of the respective said working device.

6. A method of monitoring a work train for performing track maintenance operations, the work train being mobile on a track and being composed of a plurality of work vehicles disposed one after another on the track, the work vehicles having working devices, which comprises:

transmitting vehicle characteristics identifying a respective work vehicle to a computer;

displaying the vehicle characteristics on a display of the computer in a sequence corresponding to a sequence of the work vehicles in the work train; and displaying malfunction information concerning a given work vehicle resulting from a difference between actual and desired values of parameters essential for a disturbance-free operation of the respective working devices on the display of the computer in connection with the respective vehicle characteristics and the position of the work vehicle within the work train.

7. The method according to claim 6, which comprises evaluating the malfunction information, by comparing the information to stored reference values, with regard to an influence thereof on continued unhindered working operation by the work train, and displaying a malfunction report on the display of the computer in different ways visually in dependence on the evaluation.

8. The method according to claim 7, which comprises shutting off all drives of working devices of the work vehicles in the work train if a malfunction report is evaluated as being significant.

9. In combination with a work train for performing track maintenance operations, the work train including a plurality of work vehicles disposed one after another on a track in a given sequence order and releasably connected to one another, and a plurality of working devices respectively associated with individual said work vehicles, said working devices cooperating for achieving a common work result for the work train, a control system for monitoring the work train, the control system comprising:

vehicle identifying devices respectively associated with individual work vehicles of the work train and each being configured for storing vehicle characteristics defining the respective said work vehicle;

a computer with a display; and a communication system connecting said computer with each of the vehicle identifying devices and for receiving from the individual work vehicles information concerning an operational status of the respective working device;

said computer being configured for visually displaying a malfunction report generated as a result of a detected difference between actual and desired values of parameters essential for disturbance-free operation of a particular working device, wherein the display combines the malfunction report with the vehicle characteristics of the work vehicle associated with the respective working device.

10. The control system according to claim 9, wherein said communication system includes a control line extending between the work vehicles and connecting said computer to each of the work vehicles.

11. The control system according to claim 9, wherein said display is configured for displaying visual indicator units associated respectively with said work vehicles and corresponding in number to a number of work vehicles in the work train, said indicator units being activatable in case of a corresponding malfunction report.

12. The control system according to claim 11, wherein said visual indicator units are arranged on said display in a sequence corresponding to a sequence of the work vehicles in the work train.

13. The control system according to claim 9, wherein each vehicle identifying device is further associated with a maintenance counter for tracking maintenance intervals prescribed for the respective said working device, and a time keeper activatable automatically after actuation of the respective said working device.

* * * * *